US008138453B2

(12) United States Patent
Yang et al.

(10) Patent No.: US 8,138,453 B2
(45) Date of Patent: Mar. 20, 2012

(54) ELECTRIC OVEN WITH MULTIPLE BROIL HEATERS AND METHOD FOR PREHEATING THE ELECTRIC OVEN

(75) Inventors: Jae Kyung Yang, Seoul (KR); Hyeun Sik Nam, Seoul (KR); Dong Seong Kwag, Seoul (KR); Seong Ho Cho, Seoul (KR); Wan Soo Kim, Seoul (KR)

(73) Assignee: LG Electronics Inc., Seoul (KR)

( * ) Notice: Subject to any disclaimer, the term of this patent is extended or adjusted under 35 U.S.C. 154(b) by 880 days.

(21) Appl. No.: 12/196,973

(22) Filed: Aug. 22, 2008

(65) Prior Publication Data

US 2009/0050619 A1 Feb. 26, 2009

(30) Foreign Application Priority Data

Aug. 24, 2007 (KR) ..... 10-2007-0085766

(51) Int. Cl.
*A21B 1/00* (2006.01)
*F27B 15/00* (2006.01)

(52) U.S. Cl. ..... 219/400; 219/393; 219/395; 219/397; 219/414; 219/413; 219/483; 219/484; 219/486; 219/491; 219/507; 432/27

(58) Field of Classification Search ..... 219/393, 219/395, 397–400, 414, 413, 483–484, 486, 219/491, 507; 432/27
See application file for complete search history.

(56) References Cited

U.S. PATENT DOCUMENTS

| | | | | |
|---|---|---|---|---|
| 2,035,767 | A * | 3/1936 | Schulze | 219/398 |
| 4,302,661 | A | 11/1981 | Perry, Jr. | |
| 7,759,617 | B2 * | 7/2010 | Bowles et al. | 219/452.11 |

FOREIGN PATENT DOCUMENTS

| | | | |
|---|---|---|---|
| DE | 40 27 777 | A1 | 3/1992 |
| EP | 0 084 006 | A1 | 7/1983 |
| EP | 0 161 161 | A1 | 11/1985 |
| EP | 0288916 | A2 | 11/1988 |
| FR | 1.441.139 | A | 6/1966 |
| GB | 1123747 | A | 8/1968 |

* cited by examiner

*Primary Examiner* — Shawntina Fuqua
(74) *Attorney, Agent, or Firm* — Birch, Stewart, Kolasch & Birch, LLP

(57) ABSTRACT

A electric oven is provided that includes a body, a cooking chamber located within the body for receiving food, the cooking chamber having an upper surface, a lower surface, and a rear surface joining the upper surface to the lower surface, at least one of a convection heater located at the rear surface of the cooking chamber and a bake heater located at the lower surface of the cooking chamber, and at least two broil heaters located at the upper surface of the cooking chamber, each of the at least two broil heaters being individually operable. Methods for preheating the electric oven are also provided.

8 Claims, 5 Drawing Sheets

[Figure 1]
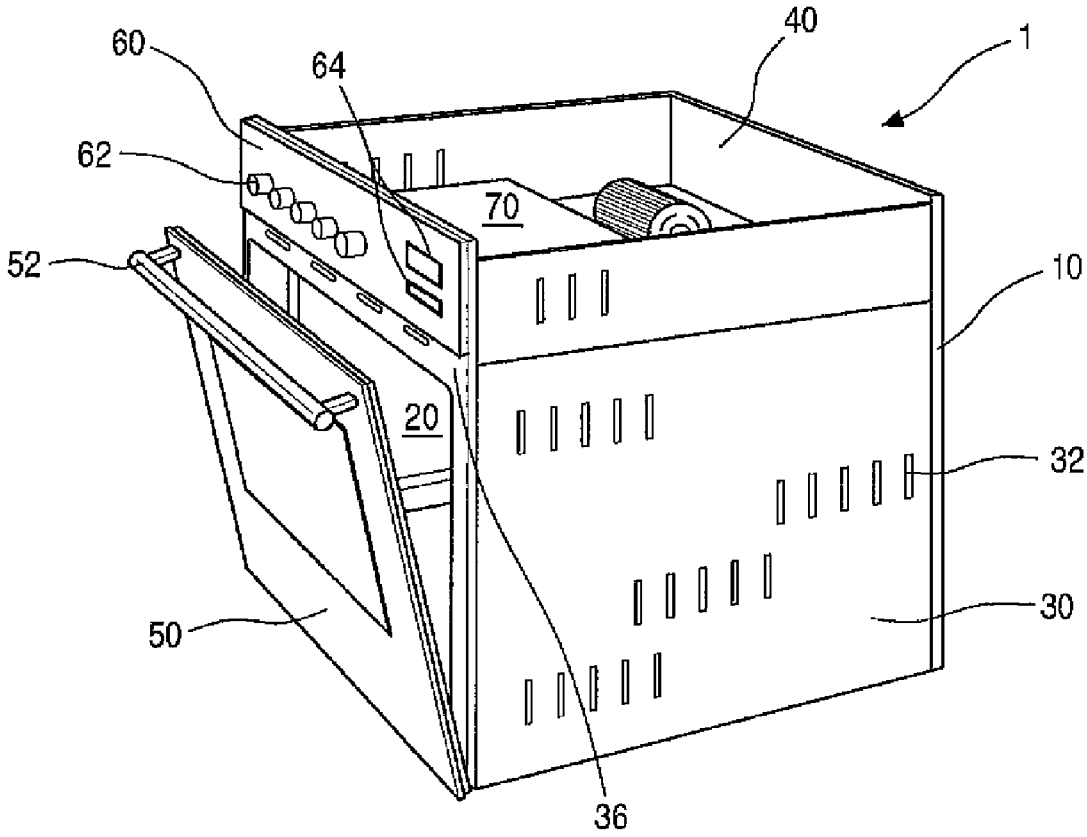

[Figure 2]
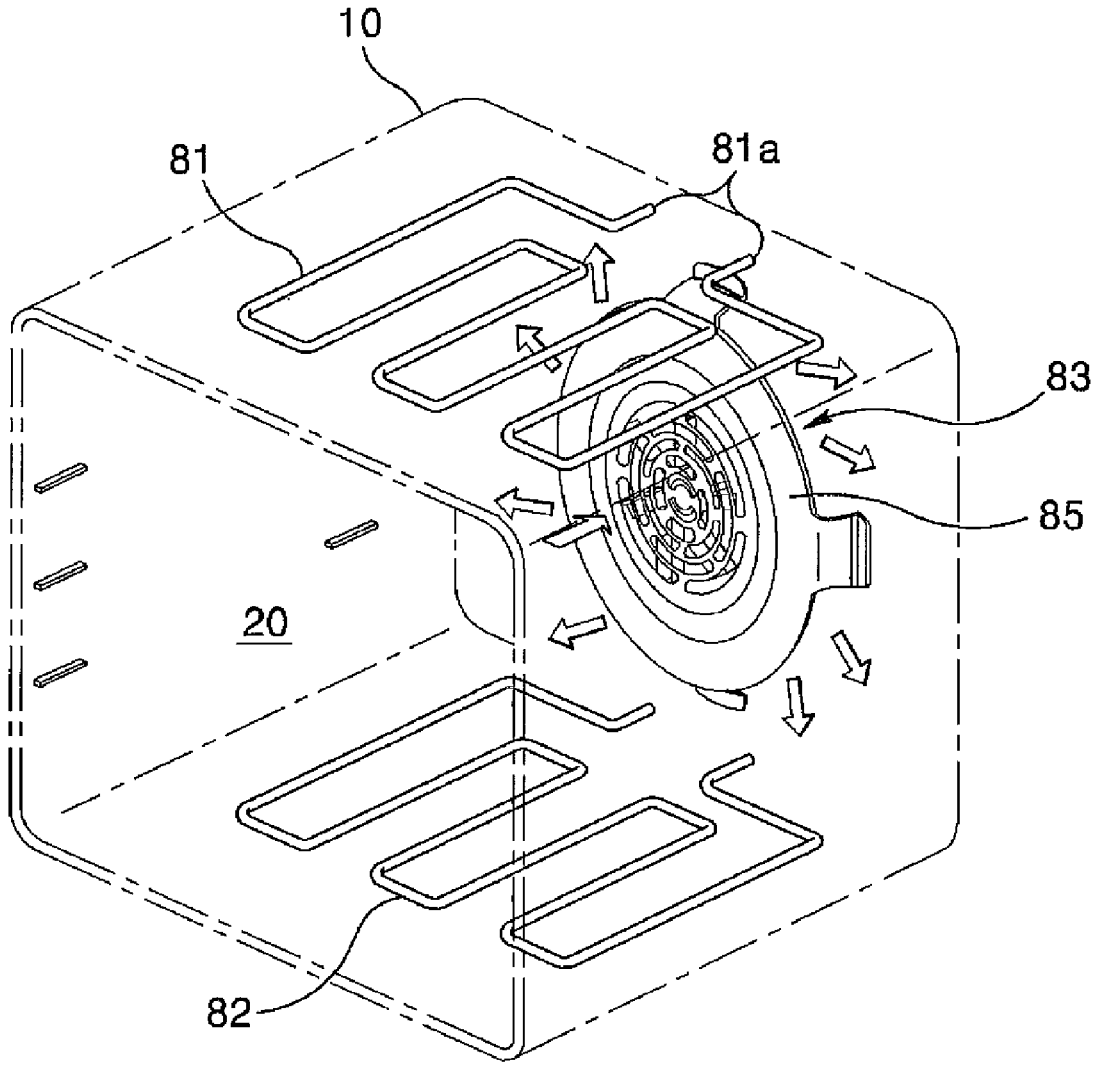

[Figure 3]
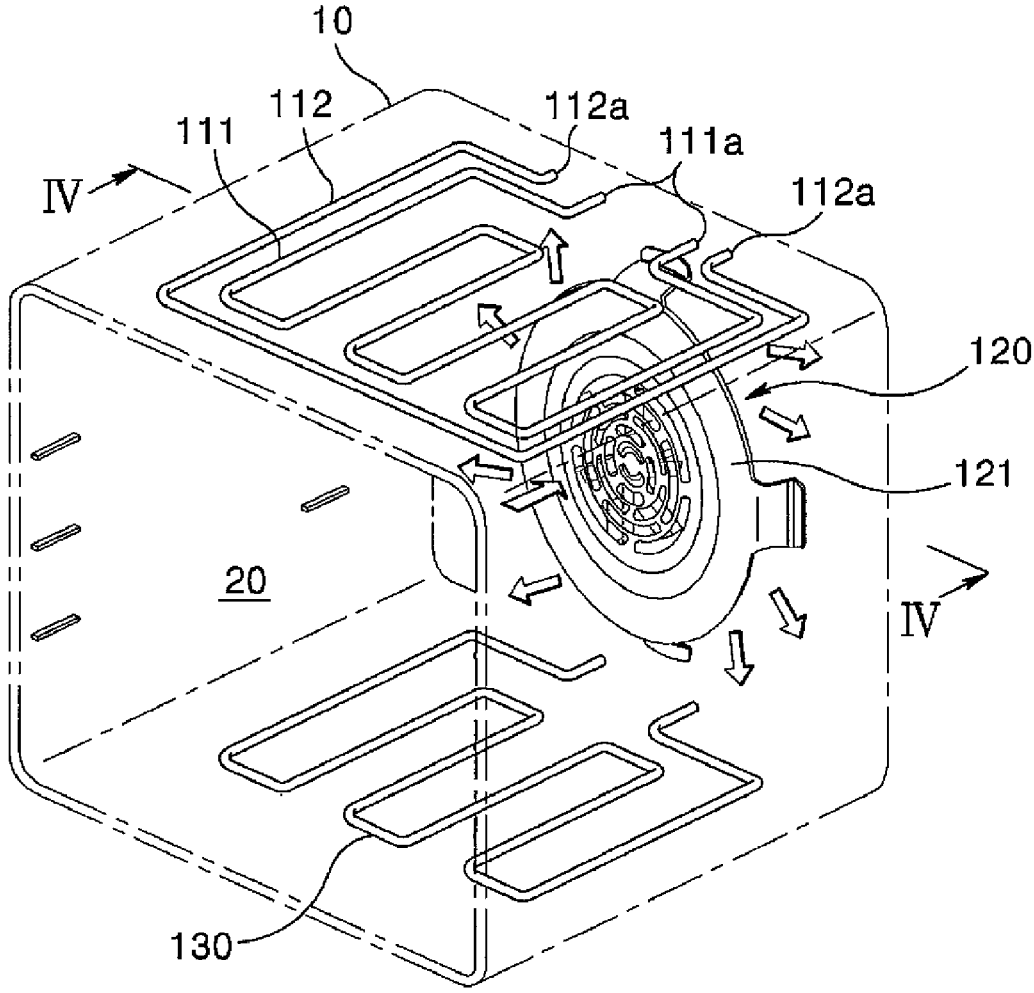
[Figure 4]
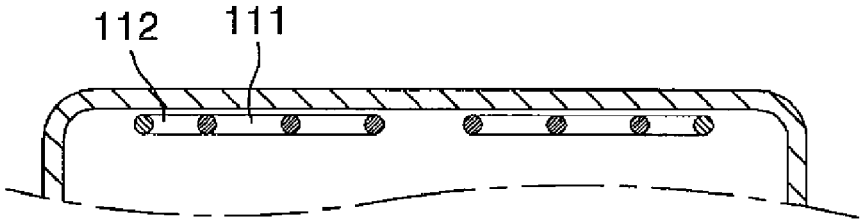

[Figure 5]
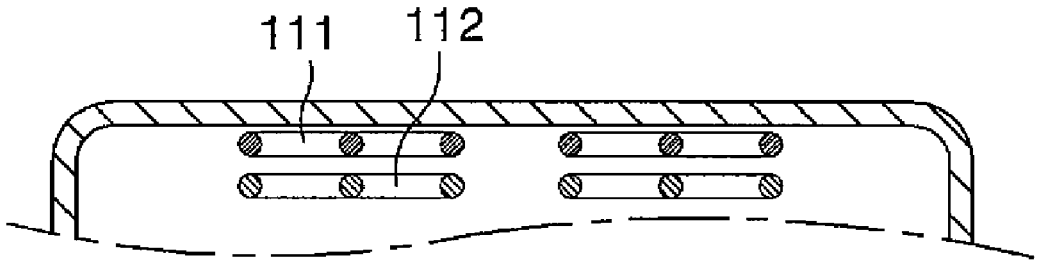
[Figure 6]
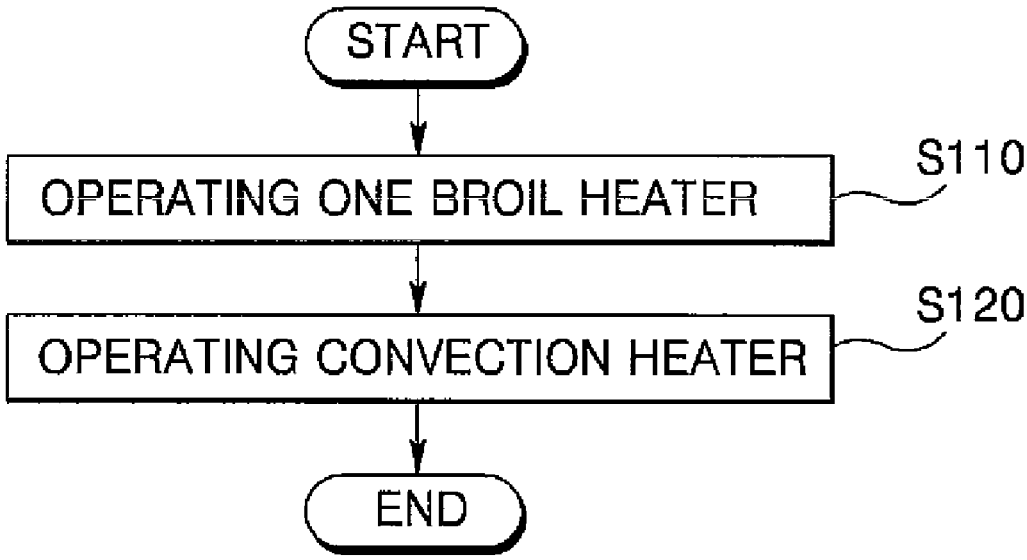

[Figure 7]
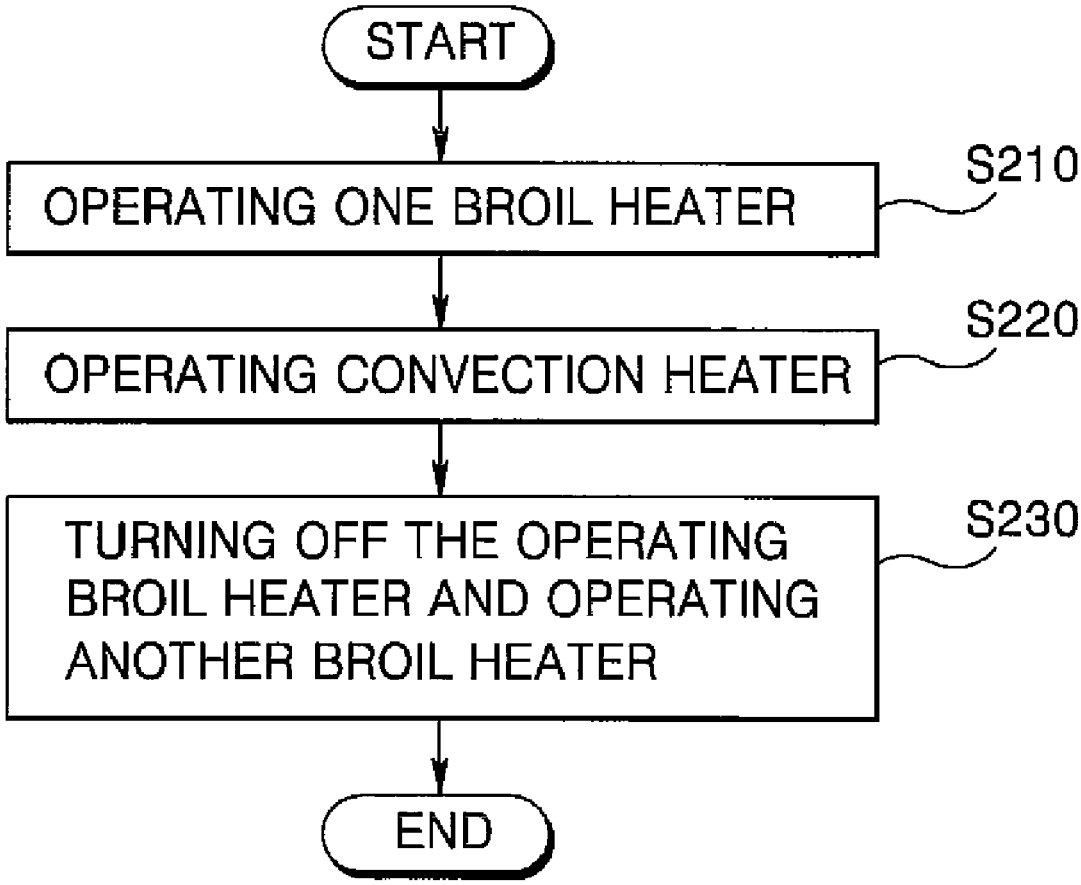

ELECTRIC OVEN WITH MULTIPLE BROIL HEATERS AND METHOD FOR PREHEATING THE ELECTRIC OVEN

CROSS-REFERENCE TO A RELATED APPLICATION

The present application claims priority to Korean Application Number 10-2007-0085766, filed Aug. 24, 2007, the disclosure of which is incorporated herein by reference in its entirety.

BACKGROUND OF THE INVENTION

1. Field of the Invention

The present invention relates generally to an electric oven, and more particularly, to an electric oven that has at least two broil heaters and a method for preheating an electric oven capable of reducing the preheating time by using one or more of the two broil heaters.

2. Description of Related Art

In general, an electric oven is a cooking appliance for heating food with dry heat, particularly after sealing the food in the cooking appliance. The dry heat may be provided using various kinds of heaters including a ceramic heater, a sheath heater, a halogen heater, and a high frequency generator (microwaves) that are operated by electricity. The electric oven has a fast cooking speed and high thermal efficiency since it heats both inside and outside of the food at the same time and is safer than gas or wood burning appliances because it is operated by electricity. Therefore, there is a trend that the electric oven is being increasingly used.

FIG. 1 is a perspective view illustrating a conventional electric oven. The electric oven 1 has an oven body 10 having a generally hexahedral shape and a cooking chamber 20 formed therein for receiving food and cooking food. Both side surfaces of the oven body 10 defining an external shape of the oven body 10 are provided with side plates 30 where a portion of the side plate 30 is formed with a plurality of side intake holes 32. The side intake holes 32 draw in external air to cool the surface of the oven body 10 and components inside the oven body 10.

The oven body 10 also includes a rear surface formed from a rear plate 40 and a front surface formed from a front plate 36. The front plate 36 includes an opening that accesses the cooking chamber 20. An oven door 50 is provided to selectively open and close the cooking chamber 20. The oven door 50 has a generally rectangular shape, and a lower end portion of the oven door 50 is pivotally hinged with a front lower end portion of the oven body 10, preferably at the front plate 36. Also, a door handle 52 is provided at an upper end portion of the oven door 50 to facilitate pivoting of the oven door 50 by being grasped by a user.

An upper front portion of the oven body 10 is provided with a control panel 60, in which operation knobs 62 for operating the electric oven 1, displays 64 for displaying the operation state of the electric oven 1, and the like are provided thereon. An electric parts chamber 70 is formed at a rear of the control panel 60, for example, at an upper portion of the cooking chamber 20. The electric part chamber 70 is configured to receive electric devices and components (not shown) for the operation of the electric oven 1, for example, a magnetron, a high voltage transformer, and a cooling fan assembly.

As shown in FIG. 2, three types of heaters are generally provided on or adjacent walls of the cooking chamber 20. For examples, a heater installed on the ceiling is generally referred to as a top heater 81, and a heater located in the bottom is generally referred to as a bottom heater 82. The top heater 81 may be in the form of a broil heater and the bottom heater 82 may be in the form of a bake heater. A third heater 83 located on the rear wall is generally referred to as a convection heater since it is generally installed together with a convention fan. The third heater 83 is protected by a cover 85.

These three types of heaters 81, 82 and 83 have different characteristics in relation to cooking of foods. The convection heater 83 transfers heat mainly by convection and is capable of making the temperature of the inside of the cooking chamber 20 to be uniform within a short time. The broil heater 81 is constituted of a high capacity heater as compared to the convection heater 83 and the bake heater 82, and the broil heater 81 is capable of heating food within a short time by radiant heat.

These heaters 81, 82, and 83 are operated alone or in combination with each other in correspondence to cooking modes that are preset according to characteristics of the food to be cooked. In addition, the on/off periods of the respective heaters and total heating time may also be controlled based on the preset cooking modes. Although all of the heaters 81, 82, and 83 may be operated at the same time, this generally results in too much power consumption. Also, when all the heaters are operated at the same time, the temperature of the cooking chamber is generally raised to an excessive level. For these reasons, cooking modes are preset so that the heaters are optimally used alone or in combination according to the characteristics of the food to be cooked. Further, even when the respective heaters are operated, total power consumed by the electric oven 1 is controlled to be limited to a predetermined upper limit value so that the power consumed does not exceed this upper limit.

In order to optimally cook certain types of foods, it is desirable that the inside of the cooking chamber is heater prior to placing the food in the cooking chamber 20. This is referred to as preheating, and it is desirable that the preheating time is short, but, at the same time, it is also important for cooking of the food to preheat the inside of the cooking chamber so that the inside of the cooking chamber has a uniform temperature distribution.

In order to uniformly raise the temperature of the inside of the cooking chamber, it is preferred to perform the preheating with the convection heater 83. This is because the heat generated by the convection heater 83 is rapidly transferred to the inside of the cooking chamber by the convection fan. However, since the convection heater 83 generates little heat as compared to the broil beater 81, the preheating of the cooking chamber takes a relatively long time.

While the broil heater 81 may generate more heat than the convection heater 83 and thus can complete the preheating within a short time, the preheating is limited with respect to a specific area. In particular, since the heat generated by the broil heater 81 is mostly transferred, not by convection, but by radiation, the temperature rise all over the cooking chamber 20 is low unless an object such as a food capable of absorbing the radiant heat is introduced into the cooking chamber 20. Also, since the temperature is rapidly raised only in the vicinity of the ceiling on which the broil heater 81 is located, there is a problem that the temperature distribution in the inside of the cooking chamber is not uniform. In other words, while the broil heater 81 consumes much power as it generates large amounts of heat, it has a low efficiency for heating the inside of the cooking chamber to provide uniform temperature distribution.

If the preheating is preformed using both the convection heater 83 and the broil heater 81, total power consumption may exceed maximum wattage preset in the electric oven.

Therefore, the preheating is performed by using only one of the convection heater 83 or the broil heater 81, or by alternating the use of the convection heater 83 and the broil heater 81 over time. The problem with preheating by the former approach is described above. The problem with preheating by the latter approach is that one heater is naturally cooled while the other heater is operated and thus additional power and time are consumed to reheat the cooled heater.

In addition, although it is possible to operate two or more heaters, including the bake heater, at the same time, it is difficult to operate two or more heaters for a long time since the power for operating the heaters should be distributed within the limit of the maximum wattage of the electric oven. That is to say, there is a limitation in that the time for which the two or more heaters are operated at the same time is very short as compared to the total preheating time and one of the heaters should be operated in a low power level when the two heaters are operated at the same time. Therefore, even with the method described above, the preheating cannot be completed within a short time and the waste of power becomes significant.

BRIEF SUMMARY OF THE INVENTION

An object of the instant disclosure is to provide an electric oven that can not only complete preheating within a short time but also provide more uniform temperature distribution inside of a cooking chamber, and a method for preheating the electric oven within a short time.

According to principles of the present invention, an electric oven is provided that includes a body, a cooking chamber located within the body for receiving food, the cooking chamber having an upper surface, a lower surface, and a rear surface joining the upper surface to the lower surface, at least one of a convection heater located at the rear surface of the cooking chamber and a bake heater located at the lower surface of the cooking chamber, and at least two broil heaters located at the upper surface of the cooking chamber, each of the at least two broil heaters being individually operable.

In a further aspect, the electric oven may include both the convection heater and the bake heater.

In a different aspect, the at least two broil heaters may include a first broil heater located in a first plane, and a second broil heater located in a second plane parallel to the first plane. The first plane may be parallel to the upper surface of the cooking chamber.

In yet another aspect, the at least two broil heaters may include a first broil heater located in a first plane, and a second broil heater located in the first plane. The second broil heater may be located to surround an outer periphery of the first broil heater.

According to principles of the present invention, a method for preheating an electric oven is provided. The electric oven includes a body, a cooking chamber located within the body for receiving food, the cooking chamber having an upper surface, a lower surface, and a rear surface joining the upper surface to the lower surface, at least one of a convection heater located at the rear surface of the cooking chamber and a bake heater located at the lower surface of the cooking chamber, and at least two broil heaters located at the upper surface of the cooking chamber, each of the at least two broil heaters being individually operable. The method includes operating one broil heater of the at least two broil heaters, and operating one of the at least one convection heater and the bake heater.

In a further aspect, when the electric oven includes both the convection heater and the bake heater, the operating one of the at least one convection heater and the bake heater may include operating only one of the convection heater and the bake heater during preheating of the electric oven.

In yet another aspect, the method may further include turning off the one of the at least two broil heaters, and operating another broil heater of the at least two broil heaters, the another broil heater of the at least two broil heaters being different from the one of the at least two broil heaters.

According to principles of the present invention, another method for preheating an electric oven is provided. The electric oven includes a body, a cooking chamber located within the body for receiving food, the cooking chamber having an upper surface, a lower surface, and a rear surface joining the upper surface to the lower surface, a convection heater located at the rear surface of the cooking chamber, a bake heater located at the lower surface of the cooking chamber, and at least two broil heaters located at the upper surface of the cooking chamber, each of the at least two broil heaters being individually operable. The method including operating one broil heater of the at least two broil heaters, operating one of the convection heater and the bake heater, turning off the one broil heater of the at least two broil heaters, and operating another broil heater of the at least two broil heaters, the another broil heater of the at least two broil heaters being different from the one broil heater of the at least two broil heaters.

Further scope of applicability of the present application will become more apparent from the detailed description given hereinafter. However, it should be understood that the detailed description and specific examples, while indicating preferred embodiments of the invention, are given by way of illustration only, since various changes and modifications within the spirit and scope of the invention will become apparent to those skilled in the art from the detailed description.

BRIEF DESCRIPTION OF THE DRAWINGS

The present invention will become more fully understood from the detailed description given hereinbelow and the accompanying drawings which are given by way of illustration only, and thus are not limitative of the present invention and wherein:

FIG. 1 is a perspective view illustrating an external shape of a conventional electric oven;

FIG. 2 is a transparent perspective view schematically illustrating an inside of a cooking chamber of the conventional electric oven of FIG. 1;

FIG. 3 is a transparent perspective view schematically illustrating an inside of a cooking chamber of an electric oven according to an exemplary embodiment of the present invention;

FIG. 4 is a cross-sectional view taken along line IV-IV in FIG. 3;

FIG. 5 is a cross-sectional view illustrating an inside of a cooking chamber of an electric oven provided according to another exemplary embodiment of the present invention;

FIG. 6 is a flowchart illustrating a method for controlling an electric oven according to an exemplary embodiment of the present invention; and FIG. 7 is a flowchart illustrating a method for controlling an electric oven according to another exemplary embodiment of the present invention.

DETAILED DESCRIPTION OF THE INVENTION

Exemplary implementations of the present inventive will now be described in detail with reference to the accompanying drawings. In this application, the use of the singular includes the plural unless specifically stated otherwise. Furthermore, the use of the term "including", as well as other forms, such as "includes" and "included", is not limiting. Wherever possible, the same reference numbers will be used throughout the drawings to refer to the same or like parts.

FIG. 3 is a transparent perspective view schematically illustrating an inside of a cooking chamber of an electric oven according to an exemplary embodiment of the present invention; FIG. 4 is a cross-sectional view taken along a line IV-IV in FIG. 3; and FIG. 5 is a cross-sectional view illustrating an inside of a cooking chamber of an electric oven according to another embodiment of the present invention.

A body 10 of an electric oven includes a cooking chamber 20 for receiving food to be cooked therein. This cooking chamber 20 may be provided with three types of heaters: broil beaters 111, 112 located adjacent the upper surface or ceiling of the cooking chamber 20, a convection heater 120 located adjacent the rear wall of the cooking chamber 20, and a bake heater 130 located adjacent the bottom surface of the cooking chamber 20. The convection heater 120 is provided with a convection cover 121.

The convection heater 120 and the bake heater 130 may have the same structure and operation as the convection heater 83 and the bake heater 82 of the conventional electric oven described with reference to FIG. 2, and therefore will not be described in greater detail unless necessary to the explanation of present invention.

The broil heaters 111, 112 may include a first broil heater 111 and a second broil heater 112. The first and second broil heaters 111 and 112 can be individually operated, and as such, may be provide with electrodes 111*a* and 112*a*, respectively, which may be supplied with power individually by respective switching devices (not shown).

The first broil heater 111 and the second broil heater 112 may be installed on the same plane, or may be installed on different planes. For example, as shown in FIGS. 3 and 4, the second broil heater 112 may be disposed in a shape surrounding the first broil heater 111, and both broil heaters 111 and 112 may be disposed on the same plane with their individual heating areas being divided. This plane may be substantially parallel to the upper surface of the cooking chamber 20. If the first broil heater 111 and the second broil heater 112 are disposed in a shape dividing the ceiling into two equal parts, a problem may occur in that the inside of the cooking chamber is non-uniformly heated. Therefore, it is preferable that the first and second broil heaters 111 and 112 are disposed so that the second broil heater 112 surrounds the outer periphery of the first broil heater 111 to further maximize uniform heat transfer generated in the inside of the cooking chamber even when only one of the two broil heaters is operated. When the broil heaters are disposed such that the second broil heater 112 surrounds the outer periphery of the first broil heater 111 as aforementioned, the first broil heater 111 and the second broil heater 112 may have different shapes from each other. By providing the first and second broil heaters 111 and 112 on the same plane, it is possible to increase the maximum usable space inside of the cooking chamber 20 by minimizing the amount of space occupied by the first and second broil heaters 111 and 112.

Alternatively, as shown in FIG. 5, the second broil heater 112 may be disposed on a plane at a different level from the plane on which the first broil heater 111 is disposed. In other words, the first broil heater 111 may be disposed on a first plane much closer to the ceiling of the cooking chamber 20 and the second broil heater 112 may be disposed on a second plane farther from to the ceiling of the cooking chamber 20. When the first broil heater 111 and the second broil heater 112 are disposed on different planes from each other as aforementioned, the inside space of the cooking chamber 20 becomes correspondingly small. However, by placing the first and second broil heaters 111 and 112 on separate planes, the first and second broil heaters 111 and 112 can be formed to have the same shape, which provides advantages to the control of parts supply and/or maintenance of parts in the course of manufacturing of the electric oven.

While the above exemplary embodiments make reference to the broil heater 111, 112 as a pair of heaters, it is understood that three or more broil heaters can be used. When a plurality of broil heaters are provided, it is possible to simultaneously operate some of the plurality of broil heaters in combination with the convection heater 120 or the bake heater 130. For example, when a pair of broil heaters is provided, it is possible to simultaneously operate one broil heater and the convection heater 120 or the bake heater 130. Therefore, convenience of use is enhanced as compared to the conventional case provided with only one broil heater in that, when the broil heater and the convection heater or the bake heater are operated at the same time, the operation time is very short or one of the heaters cannot generate heat of a sufficient level since the power consumption exceeds the maximum wattage allowed for the electric oven. The enhanced convenience of use is particularly noticeable in a preheating process that will be described below.

Hereinafter, exemplary implementations of a method for preheating an electric oven according to the present invention will be described in detail with reference to FIGS. 6 and 7, where FIG. 6 is a flow chair illustrating a method for controlling an electric oven according to an exemplary embodiment of the present invention and FIG. 7 is a flowchart illustrating a method for controlling an electric oven according to another exemplary embodiment of the present invention.

In order to preheat the electric oven 1 having the aforementioned structure, one broil heater of at least two broil heaters 111, 112 is first operated (S110). Next, one of the convection heater 120 and the bake heater 130 is operated (S120). Although FIG. 6 illustrates the case that the convection heater 120 is selected, it is also possible to operate the bake heater 130 instead of the convection heater 120. The step S110 of operating one of the broil heaters 111, 112 and the step S120 of operating the convection heater 120 or the bake heater 130 are not necessary to be time-sequentially performed, and the two steps S110 and S120 may be performed at the same time or be preformed in reverse order.

When a plurality of broil heaters 111, 112 are provided as described above, it is possible to preheat within a shorter time than when preheating using the convection heater 120 or the bake heater 130 alone since it is possible to perform the preheat using some of the broil heaters 111, 112 in combination with the convection heater 120 or the bake heater 130. Also, since some of the plurality of the broil heaters 111, 112 are operated, the preheating can be performed so that the power consumption does not exceed the maximum wattage allowed for the electric oven 1 even when the convection heater 120 or the hake heater 130 is operated at the same time.

As shown in FIG. 7, a second method for controlling an electric oven 1 according to another exemplary embodiment of the present invention includes similar steps to the first exemplary method described above, namely, operation of one of the broil heaters (S110) and operation of one selected from the convection heater or the bake heater (S120) are common to both methods. However, this method further includes stopping the operation of the broil heater that is operating and operating another broil heater (S230). This is particularly useful to uniformly preheat the inside of the cooking chamber 20 when broil heaters 111, 112 are disposed on the same plane. For example, as shown in FIG. 4, in a case that the first broil heater 111 and the second broil heater 112 are disposed on the same plane, when the first broil heater 111 is first operated, the operation of the first broil heater 111 is stopped after the lapse of a predetermined time and the second broil heater 112 is operated so as to be operated together with the convection heater 120. When the first broil heater 111 is operated together along with the convection heater 120, a temperature gradient between the upper central portion and the upper peripheral portion of the cooking chamber 20 occurs because the upper central portion of the cooking chamber 20 at which the first broil heater 111 is disposed is heated faster than the upper peripheral portion. In this exemplary embodiment, by turning off the first broil heater 111 and operating the second broil heater 112, it is possible to preheat the cooking chamber 20 so that the temperature distribution in the cooking chamber 20 is more uniform. In addition, it is possible to preheat the peripheral portion of the cooking chamber 20 such that the power consumption still does not exceed the maximum wattage of the electric oven 1.

Although the first broil heater 111 and the second broil heater 112 are exemplified as described above, an electric oven may be provided with three or more broil heaters, in which case a plurality of the broil heaters may be circularly operated in such a manner that the plurality of the broil heaters are operated in turn and the first operated broil heater is operated again after all the remaining broil heaters are operated in turn.

As described above, since the electric oven according to the present invention is provided with a plurality of broil heaters and can individually operate the broil heaters, it is possible to operate some of the broil heaters and a convection heater or a bake heater at the same time within a limit of maximum wattage allowed for the electric oven. As a result, a user can have many different options for operating the heater(s) according to characteristics of the food to be cooked, thereby enhancing the convenience of the user.

Also, the electric oven according the exemplary allow rapid and uniform preheating with lower power because it is possible to operate the convection heater or the bake heater and one of the broil heaters at the same time.

The invention thus being described, it will be obvious that the same may be varied in many ways. Such variations are not to be regarded as a departure from the spirit and scope of the invention, and all such modifications as would be obvious to one skilled in the art are intended to be included within the scope of the following claims.

What is claimed is:

1. An electric oven comprising:

a body;

a cooking chamber located within the body for receiving food, the cooking chamber having an upper surface, a lower surface, and a rear surface joining the upper surface to the lower surface;

at least one of a convection heater located at the rear surface of the cooking chamber and a bake heater located at the lower surface of the cooking chamber; and at least two broil heaters located at the upper surface of the cooking chamber, each of the at least two broil heaters being individually operable, wherein the at least two broil heaters include:

a first broil heater located in a first plane; and a second broil heater located in a second plane parallel to the first plane, the first broil heater being vertically stacked over the second broil heater.

2. The electric oven of claim 1, further comprising both the convection heater and the bake heater.

3. The electric oven of claim 1, wherein the first plane is parallel to the upper surface of the cooking chamber.

4. A method for preheating an electric oven, the electric oven including a body, a cooking chamber located within the body for receiving food, the cooking chamber having an upper surface, a lower surface, and a rear surface joining the upper surface to the lower surface, at least one of a convection heater located at the rear surface of the cooking chamber and a bake heater located at the lower surface of the cooking chamber, and at least two broil heaters located at the upper surface of the cooking chamber, each of the at least two broil heaters being individually operable, the at least two broil heaters including:

a first broil heater located in a first plane; and a second broil heater located in a second plane parallel to the first plane, the first broil heater being vertically stacked over the second broil heater, the method comprising:

operating one broil heater of the at least two broil heaters; and operating one of the at least one convection heater and the bake heater.

5. The method of claim 4, wherein the electric oven includes both the convection heater and the bake heater, and wherein operating one of the at least one convection heater and bake heater includes operating only one of the convection heater and the bake heater during preheating of the electric oven.

6. The method of claim 4, further comprising:

turning off the one of the at least two broil heaters; and operating another broil heater of the at least two broil heaters, the another broil heater of the at least two broil heaters being different from the one of the at least two broil heaters.

7. A method for preheating an electric oven, the electric oven including a body, a cooking chamber for receiving food formed in the body, the cooking chamber having an upper surface, a lower surface, and a rear surface joining the upper surface to the lower surface, a convection heater located at the rear surface of the cooking chamber, a bake heater located at the lower surface of the cooking chamber, and at least two broil heaters located at the upper surface of the cooking chamber, each of the at least two broil heaters being individually operable, the at least two broil heaters including:

a first broil heater located in a first plane; and a second broil heater located in a second plane parallel to the first plane, the first broil heater being vertically stacked over the second broil heater, the method comprising:

operating one broil heater of the at least two broil heaters;

operating one of the convection heater and the bake heater;

turning off the one broil heater of the at least two broil heaters; and operating another broil heater of the at least two broil heaters, the another broil heater of the at least two broil heaters being different from the one of broil heater of the at least two broil heaters.

8. The method of claim 7, wherein operating one of the convection heater and the bake heater includes operating only one of the convection heater and the bake heater during preheating of the electric oven.

* * * * *